US008128298B2

(12) United States Patent
Fowler et al.

(10) Patent No.: US 8,128,298 B2
(45) Date of Patent: Mar. 6, 2012

(54) HINGE WITH SLIDING PIVOT TRANSFER

(75) Inventors: Roger Guy Fowler, Apex, NC (US); Dean Frederick Herring, Youngsville, NC (US)

(73) Assignee: International Business Machines Corporation, Armonk, NY (US)

( * ) Notice: Subject to any disclaimer, the term of this patent is extended or adjusted under 35 U.S.C. 154(b) by 1125 days.

(21) Appl. No.: 11/950,985

(22) Filed: Dec. 5, 2007

(65) Prior Publication Data

US 2009/0148223 A1 Jun. 11, 2009

(51) Int. Cl.
*B41J 29/02* (2006.01)

(52) U.S. Cl. ..... 400/693; 16/239; 16/287; 16/362

(58) Field of Classification Search ..... 400/693
See application file for complete search history.

(56) References Cited

U.S. PATENT DOCUMENTS 1,075,130 A * 10/1913 Streberger ..... 16/358
2,143,736 A * 1/1939 Lefevre ..... 16/361
2,154,733 A 4/1939 Orlow
2,195,093 A * 3/1940 Neal ..... 16/368
2,548,492 A 4/1951 Rivard et al.
2,674,761 A 4/1954 Weiss
2,686,332 A 8/1954 Tull et al.
2,698,959 A 1/1955 Vigmostad
3,001,225 A * 9/1961 Squire ..... 16/287
3,113,339 A 12/1963 Krause
3,388,417 A * 6/1968 Upchurch ..... 16/361
4,909,645 A * 3/1990 Sudo et al. ..... 400/120.16
5,062,182 A * 11/1991 Griffiths et al. ..... 16/368
6,022,158 A 2/2000 Nakayama et al.
6,155,730 A 12/2000 Nakayama et al.
6,474,883 B1 11/2002 Kawakami et al.
6,607,322 B2 8/2003 Aruga et al.
6,997,628 B2 2/2006 Tu
2005/0232679 A1 10/2005 Na et al.
2007/0065222 A1 3/2007 Nagata

* cited by examiner

*Primary Examiner* — Jill Culler
(74) *Attorney, Agent, or Firm* — Yee & Associates, P.C.; Tom Tyson

(57) ABSTRACT

Exemplary embodiments provide for a method and apparatus for moving a cover of a device relative to a base of the device to provide access to an interior space. An indication to open a cover coupled to a base is received. Responsive to receiving the indication, the cover is sequentially pivoted around a first pivot and a second pivot to provide access to the interior space while maintaining the cover within a footprint of the device.

12 Claims, 17 Drawing Sheets

HINGE WITH SLIDING PIVOT TRANSFER

BACKGROUND OF THE INVENTION

1. Field of the Invention

The present invention relates generally to printers. More specifically, the present invention relates to a method and apparatus for moving a printer cover to clear a platen and print head while remaining within the footprint of the printer.

2. Description of the Related Art

Covers may be used to partially or completely conceal components of various devices. Covers may also provide functionality to the device to which the cover is associated. In many cases, the cover is coupled to the device to which the cover is associated. For example, a cover may be a hood that is coupled to the exterior of an automobile. In this example, the hood may both conceal components of the automobile, such as the engine and radiator, and provide protection for those same components.

Many types of printers, such as point of sale printers, use covers to conceal printer components or to provide functionality for the printer. In one specific example, covers may be used to conceal one or more compartments of a printer, such as a compartment used to store paper that is used by the printer. In another example, a cover may both conceal printer components and provide functionality for the printer, such as acting as a paper feed tray.

Many printer covers are able to move relative to the printer. For example, a printer may include a lid that is pivotably attached to the printer. In this example, the lid may be lifted into an open position relative to an axis located at the pivot point such that a compartment, such as a paper supply compartment, is exposed when the cover is lifted.

Covers on point of sale printers may be particularly susceptible to abuse by users. Point of sale printers are often utilized in fast-paced environments, such as retail stores and other transaction centers. Thus, components associated with the point of sale printer, including covers, touch displays, and keyboards may experience excessive amounts of wear and tear. This problem is compounded for printer components or compartments that require access, such as hinged covers that must be opened to replenish paper for the printer.

Often printers are installed at a location where there is limited space to operate the printer. Frequently printers are installed next to a wall, a pole, or other obstruction that limits the space in which the printer may operate. This can be a problem particularly in regards to loading and unloading paper, when a printer is required to be opened up. Typically opening up the print requires the printer to encompass a larger area than before. Frequently, parts of the printer may extend beyond the initial footprint of the printer. A footprint is equal to the amount of floor space that the printer occupies, when closed.

Therefore, it would be advantageous to have an improved method and apparatus to move a cover that overcomes some or all of the above-described problems.

BRIEF SUMMARY OF THE INVENTION

Exemplary embodiments provide for a method and apparatus for moving a cover of a device relative to a base of the device to provide access to an interior space. An indication to open a cover coupled to a base is received. Responsive to receiving the indication, the cover is sequentially pivoted around a first pivot and a second pivot to provide access to the interior space while maintaining the cover within a footprint of the device.

BRIEF DESCRIPTION OF THE SEVERAL VIEWS OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
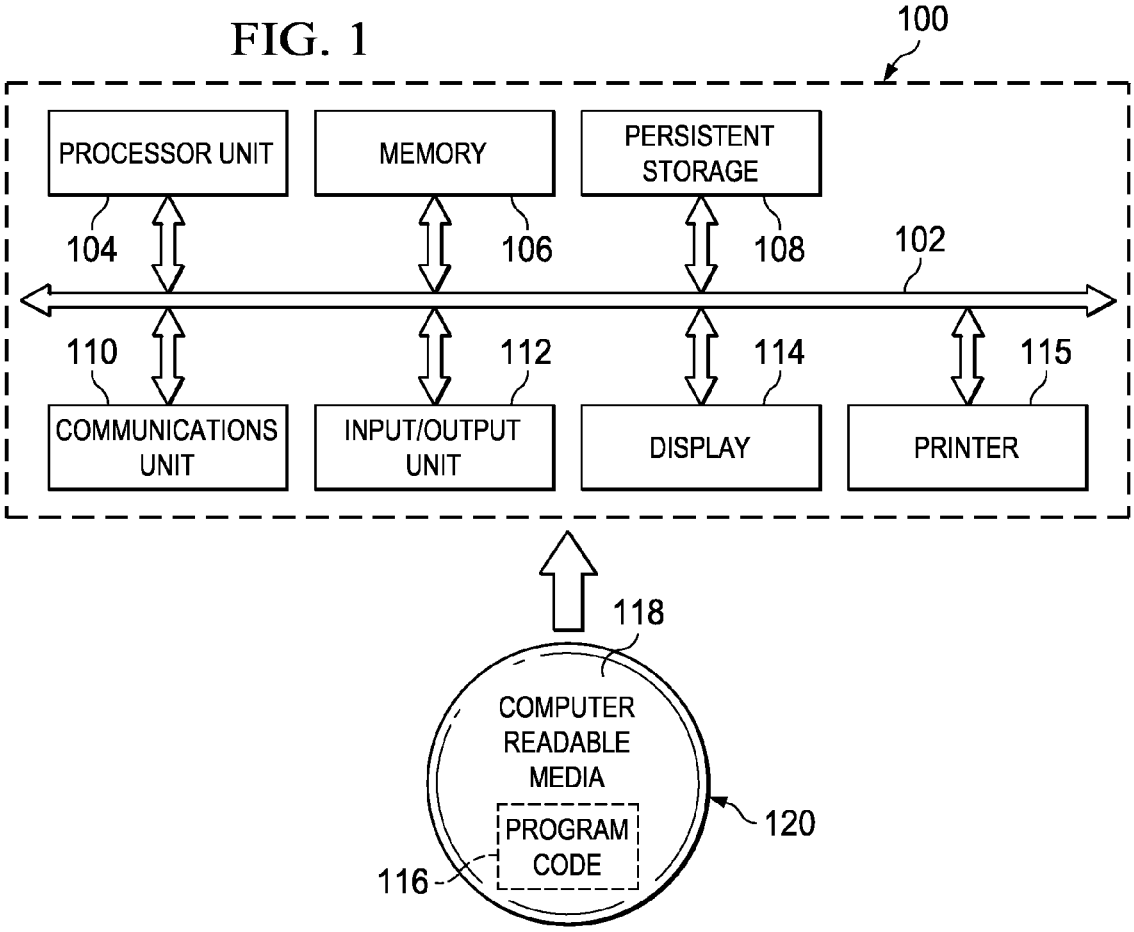
FIG. 1 is a block diagram of a data processing system in accordance with an illustrative embodiment of the present invention.

Turning now to FIG. 1, a block diagram of a data processing system is depicted in accordance with an illustrative embodiment of the present invention. In this illustrative example, data processing system 100 includes communications fabric 102, which provides communications between processor unit 104, memory 106, persistent storage 108, communications unit 110, input/output (I/O) unit 112, display 114, and printer 115.

Processor unit 104 serves to execute instructions for software that may be loaded into memory 106. Processor unit 104 may be a set of one or more processors or may be a multiprocessor core, depending on the particular implementation. Further, processor unit 104 may be implemented using one or more heterogeneous processor systems in which a main processor is present with secondary processors on a single chip. As another illustrative example, processor unit 104 may be a symmetric multi-processor system containing multiple processors of the same type.

Memory 106, in these examples, may be, for example, a random access memory. Persistent storage 108 may take various forms depending on the particular implementation. For example, persistent storage 108 may contain one or more components or devices. For example, persistent storage 108 may be a hard drive, a flash memory, a rewritable optical disk, a rewritable magnetic tape, or some combination of the above. The media used by persistent storage 108 also may be removable. For example, a removable hard drive may be used for persistent storage 108.

Communications unit 110, in these examples, provides for communications with other data processing systems or devices. In these examples, communications unit 110 is a network interface card. Communications unit 110 may provide communications through the use of either or both physical and wireless communications links.

Input/output unit 112 allows for input and output of data with other devices that may be connected to data processing system 100. For example, input/output unit 112 may provide a connection for user input through a keyboard and mouse. Further, input/output unit 112 may send output to printer 115. Display 114 provides a mechanism to display information to a user.

Instructions for the operating system and applications or programs are located on persistent storage 108. These instructions may be loaded into memory 106 for execution by processor unit 104. The processes of the different embodiments may be performed by processor unit 104 using computer implemented instructions, which may be located in a memory, such as memory 106. These instructions are referred to as, program code, computer usable program code, or computer readable program code that may be read and executed by a processor in processor unit 104. The program code in the different embodiments may be embodied on different physical or tangible computer readable media, such as memory 106 or persistent storage 108. In one embodiment, the program code may be executed to perform processes, such as printing a receipt on printer 115 for transactions that occurs at a point of sale.

Printer 115 may be used to print any type of document. Instructions may be sent to printer 115 on communications fabric 102 to provide printer 115 with a set of parameters relating to the printing of one or more documents. These parameters may contain, for example, data that should be printed on a receipt to be printed by printer 115 at a point of sale. In addition, because printer 115 is compatible with a variety of different operating systems, such as Microsoft® Windows or Unix, instructions may be sent to printer 115 regardless of the operating system executing on data processing system 100. Microsoft and Windows are trademarks of Microsoft Corporation in the United States, other countries, or both. Printer 115 may be connected to one or more of the other components of the FIG. 1 via a direction connection, such as a bus, or over a network, such as the Internet.

Program code 116 is located in a functional form on computer readable media 118 and may be loaded onto or transferred to data processing system 100 for execution by processor unit 104. Program code 116 and computer readable media 118 form computer program product 120 in these examples. In one example, computer readable media 118 may be in a tangible form, such as, for example, an optical or magnetic disc that is inserted or placed into a drive or other device that is part of persistent storage 108 for transfer onto a storage device, such as a hard drive that is part of persistent storage 108. In a tangible form, computer readable media 118 also may take the form of a persistent storage, such as a hard drive or a flash memory that is connected to data processing system 100. The tangible form of computer readable media 118 is also referred to as computer recordable storage media.

Alternatively, program code 116 may be transferred to data processing system 100 from computer readable media 118 through a communications link to communications unit 110 and/or through a connection to input/output unit 112. The communications link and/or the connection may be physical or wireless in the illustrative examples. The computer readable media also may take the form of non-tangible media, such as communications links or wireless transmissions containing the program code.

The different components illustrated for data processing system 100 are not meant to provide architectural limitations to the manner in which different embodiments may be implemented. The different illustrative embodiments may be implemented in a data processing system including components in addition to or in place of those illustrated for data processing system 100. Other components shown in FIG. 1 can be varied from the illustrative examples shown.

For example, a bus system may be used to implement communications fabric 102 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 106 or a cache such as found in an interface and memory controller hub that may be present in communications fabric 102.

Figure 2:
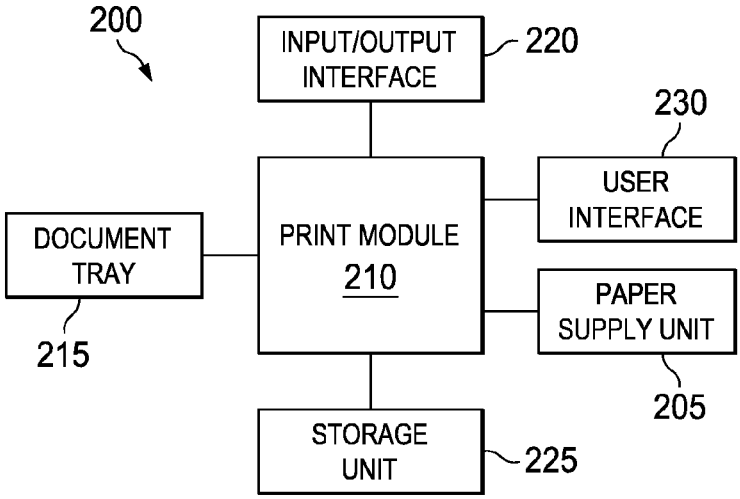
FIG. 2 is a block diagram of a printer in which the illustrative embodiments may be implemented.

Turning now to FIG. 2, a block diagram of a printer is depicted in which the illustrative embodiments may be implemented. Printer 200 is a non-limiting example of printer 115 in FIG. 1. In this illustrative example, printer 200 may be any type of printer, such as, for example, a thermal printer, toner-based printer, liquid inkjet printer, solid ink printer, dye-sublimation printer, inkless printer, impact printer, daisy wheel printer, dot-matrix printer, line printer, or a pen-based plotter. Printer 200 may be used in any type of application, such as a point of sale printer, an office printer, or a home-use printer. A point of sale printer is sometimes referred to as a fiscal printer.

Printer 200 includes paper supply unit 205. Paper supply unit 205 holds printable media that is used by printer 200 to print documents. The printable media in paper supply unit 205 may take a variety of forms, such as a roll of printable media or a stack of pre-cut sheets of printable media. The printable media may be made of any material that is capable of being printed on by printer 200, such as paper or heat-sensitive material.

Printer 200 includes print module 210. Print module 210 is the hardware in printer 200 that prints on the printable media to create a document. For example, print module 210 may apply ink to a paper in paper supply unit 205 using a toner. In another example, print module 210 uses thermal-printing techniques by selectively heating regions of portions of a roll of heat-sensitive paper in paper supply unit 205. In another example, print module 210 applies ink to one or more sheets of pre-cut paper in paper supply unit 205.

Documents created in print module 210 exit printer 200 at document tray 215. The documents at document tray 215 may be retrieved by a user or by another device for processing.

Printer 200 includes input/output interface 220. Input/output interface 220 is an interface between printer 200 and any external devices. Input/output interface 220 may be, for example, one or more ports into which a detachable storage device may be received. Input/output interface 220 may also be a connection port into which a computer, point of sale device, cash register, or any other data processing system is connected. For example, printer 200 may be connected to one or more of the components of printer 200 via input/output interface 220.

Data received at input/output interface 220 may be sent to other components of printer 200 and used in the creation of documents. For example, transaction information may be sent to printer 200 at input/output interface 220 from a point of sale device so that a receipt may be printed using a roll of heat-sensitive paper in paper supply unit 205. This data may be buffered or otherwise stored in storage unit 225. Storage unit 225 may be random access memory, a hard drive, or detachment forms of memory.

Printer 200 also includes user interface 230. User interface 230 includes any controls that allow a user to adjust settings for printer 200. For example, user interface 230 may include controls that allow a user to select a type of paper in paper supply unit 205 to be used to create a document. User interface 230 may also include a control, such as a button or knob, which opens the cover of printer 200. The cover may enclose the paper in paper supply unit 205. Alternatively, user interface 230 may be displayed on a graphical user interface of data processing system that is connected to printer 200 via input/output interface 220.

The illustrative embodiments described herein provide an apparatus and method for moving a cover. The apparatus includes a base. A base is any device onto which a cover may be attached. The apparatus also includes a cover pivotably coupled to the base. As used herein, the term "coupled" includes coupling via a separate object. For example, the cover may be coupled to the base if both the cover and the base are coupled to a third object. The term "coupled" also includes "directly coupled," in which case the two objects touch each other in some way. The term "coupled" also encompasses two or more components that are continuous with one another by virtue of each of the components being formed from the same piece of material.

The apparatus in the illustrative embodiments also includes a set of flexible bands. The set of flexible bands includes two or more flexible bands. In one illustrative embodiment, the set of flexible bands are a set of extension springs. In an alternate illustrative embodiment, the set of flexible bands are a set of torsion springs. In one illustrative embodiment, the set of flexible bands are a set of tension bands.

A first end of a first member of the set of flexible bands is coupled to the cover. A second end of the first member of the set of flexible bands is coupled to the base. Both ends of a second member of the set of flexible bands are coupled to the base at a set of second points. The set of flexible bands are adapted to bias the cover into an open position.

In one illustrative embodiment, the base is a printer, such as a point of sale printer. In this embodiment, the cover may be a printer cover. In one example, the set of flexible bands urge or bias the printer cover into the open position when the printer cover is opened by a user. In another example, the printer cover may be opened by the user using a button on the point of sale printer.

It should be noted that while exemplary embodiments have been described in terms of a printer and printer cover, exemplary embodiments encompass any type of covered device, such as a fax machine, scanner, and so forth.

Figure 3A:
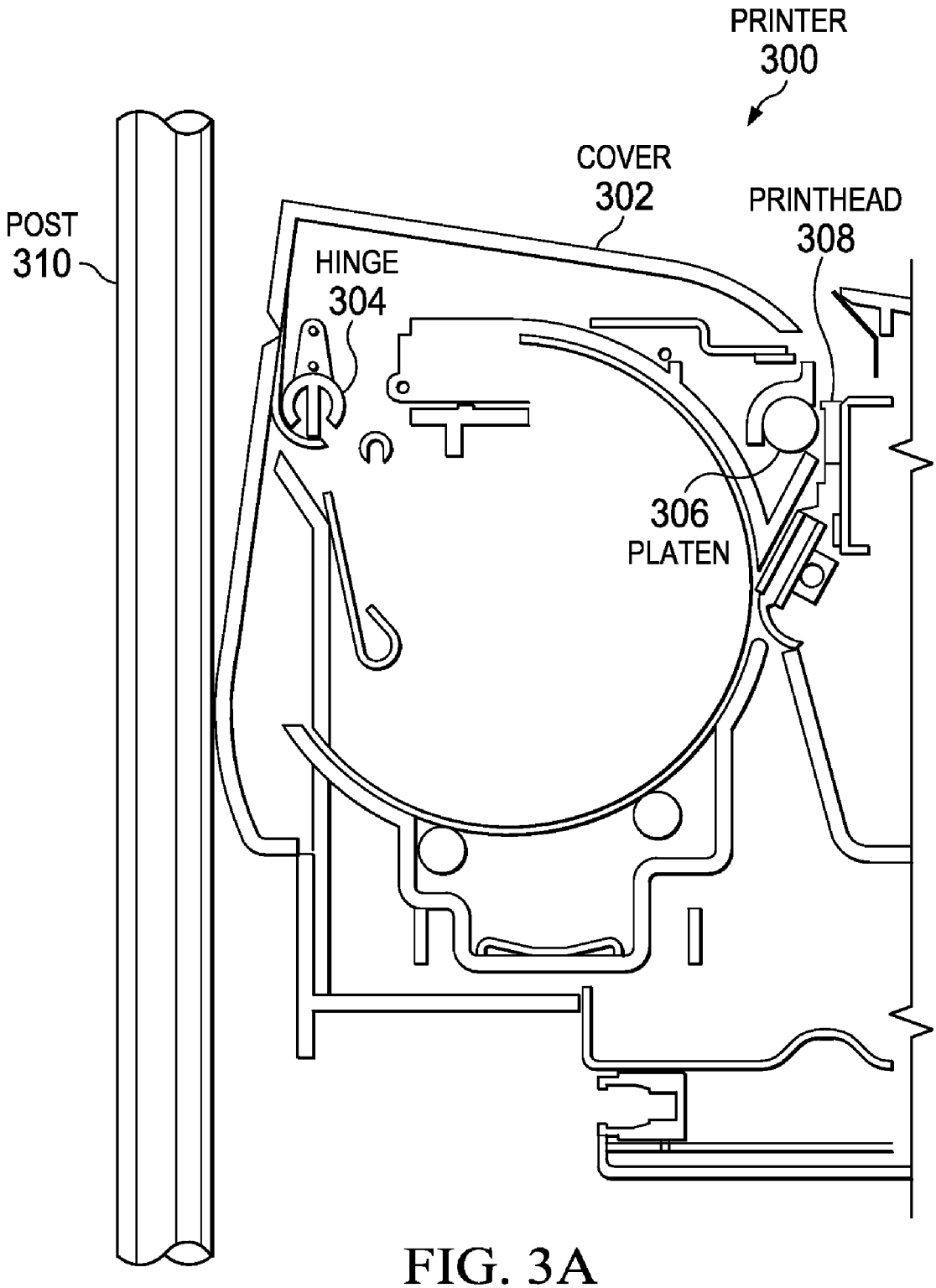
FIG. 3A (PRIOR ART)
FIGS. 3A-3C illustrate an example of a problem with current printer cover hinges.
Figure 3B:
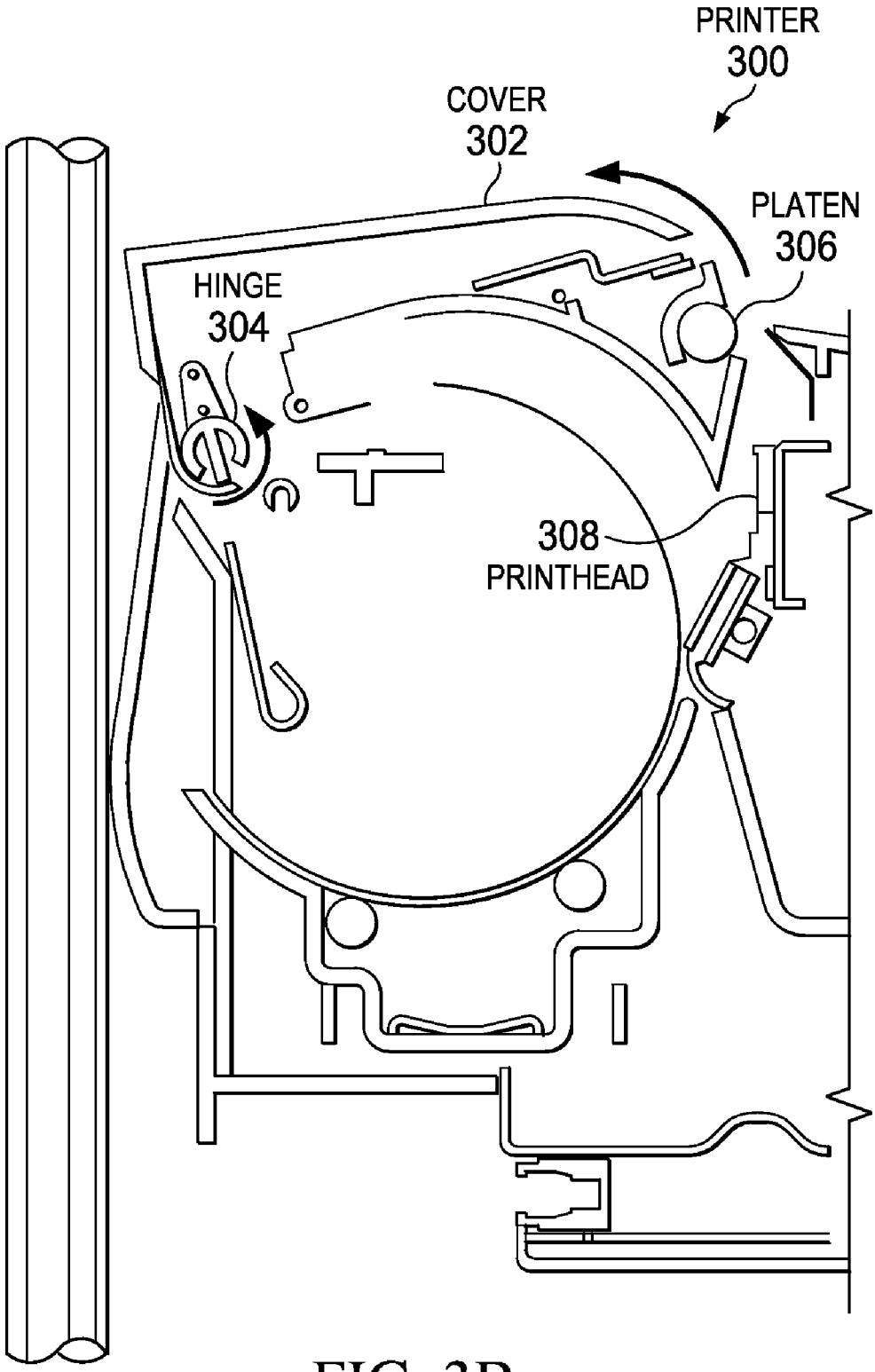
FIG. 3B (PRIOR ART)
Figure 3C:
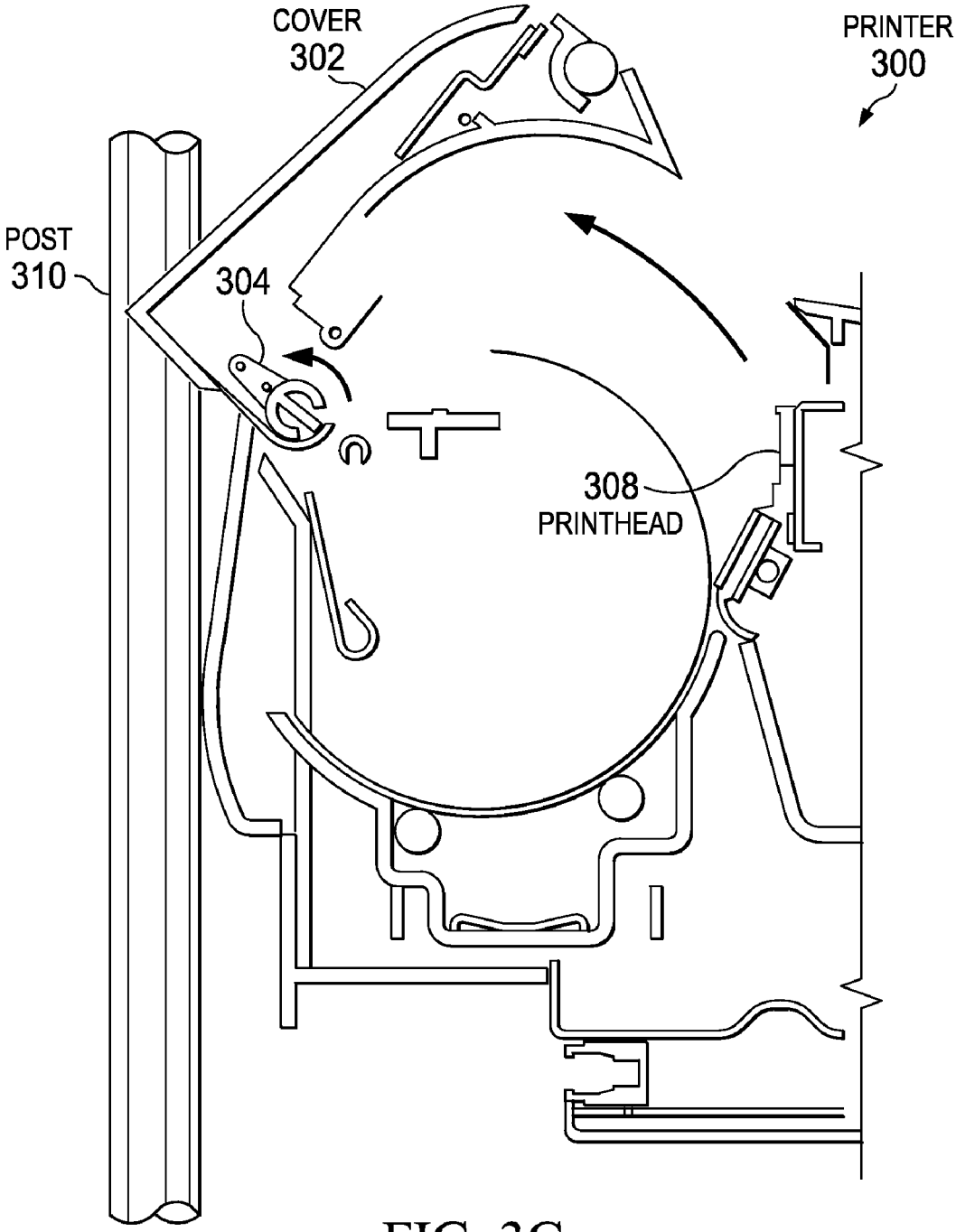
FIG. 3C (PRIOR ART)

FIGS. 3A-3C illustrate an example of a problem with current printer cover hinges. FIG. 3A is a side view of a portion of printer 300. Printer 300 is a non-limiting example of printer 115 in FIG. 1 and printer 200 in FIG. 2. As shown, printer 300 is close to post 310. Printer 300 comprises cover 302, hinge 304, platen 306 and print head 308. When printer 300 is opened, cover 302 pivots about hinge 304 in a counter clockwise direction in the figure, creating a clearance between cover 302 with attached platen 306 and print head 308, as shown in FIG. 3B. FIG. 3C shows that cover 302 of printer 300 continues rotating about hinge 304 until cover 302 rotates into post 310.

Figure 4A:
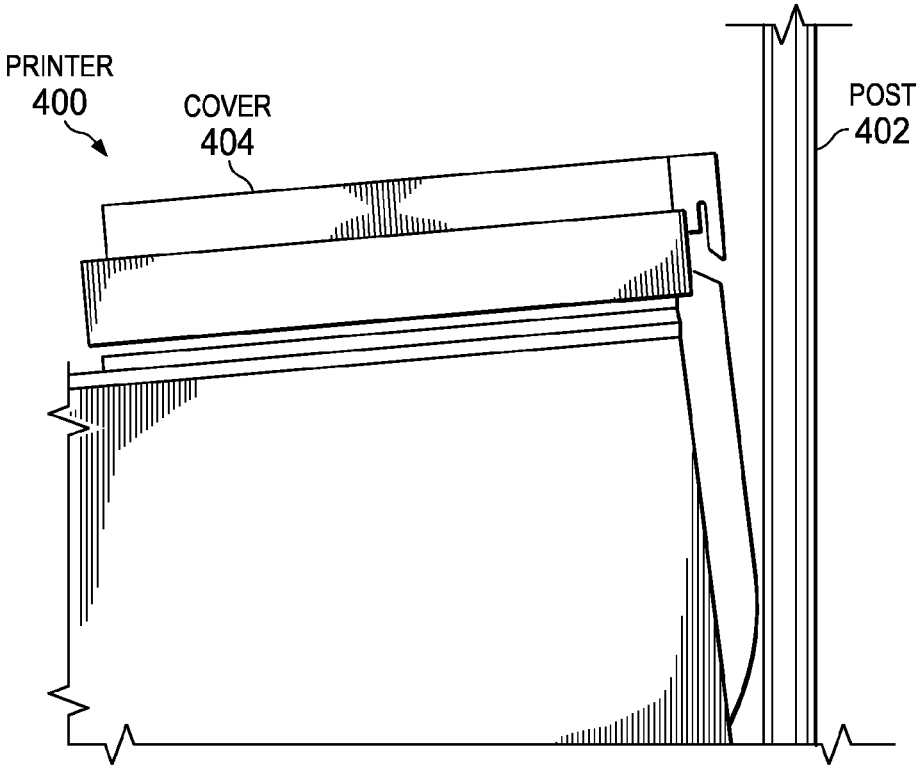
FIGS. 4A-4D illustrate an example of opening a printer cover in accordance with an exemplary embodiment.
Figure 4B:
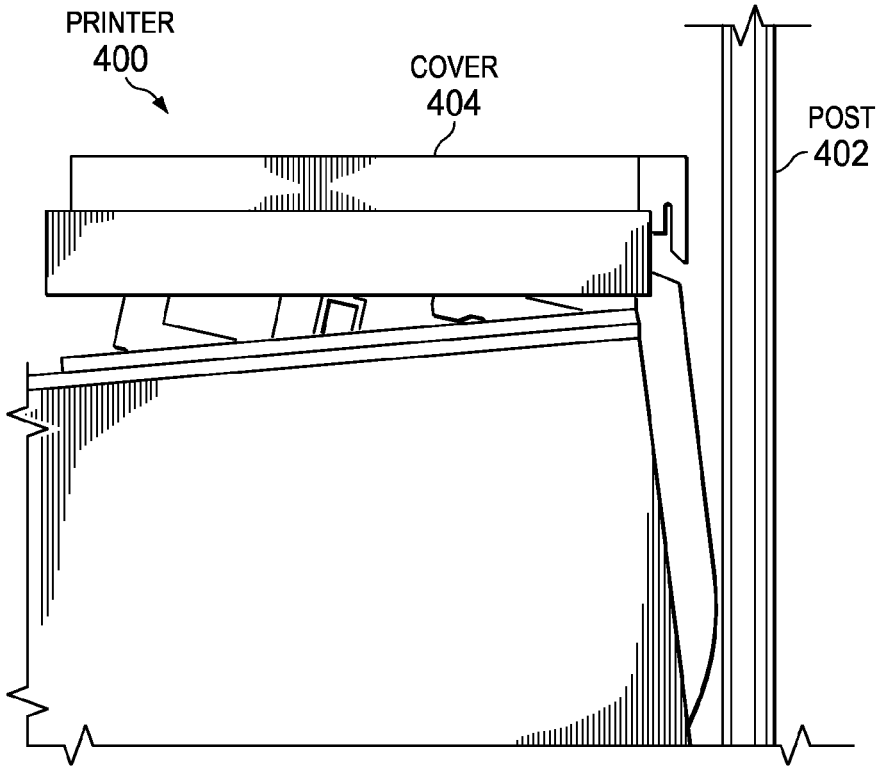

FIGS. 4A-4D illustrate an example of opening a printer cover in accordance with an exemplary embodiment. FIG. 4A is a side view of a portion of printer 400. Printer 400 is a non-limiting example of printer 115 in FIG. 1 and printer 200 in FIG. 2. As shown, printer 400 is close to post 402. In FIG. 4A, printer 400 is shown with cover 404 in a closed position. FIG. 4B shows printer 400 still close to post 402 as cover 404 begins to rotate up about a first pivot, which is not shown.

Figure 4C:
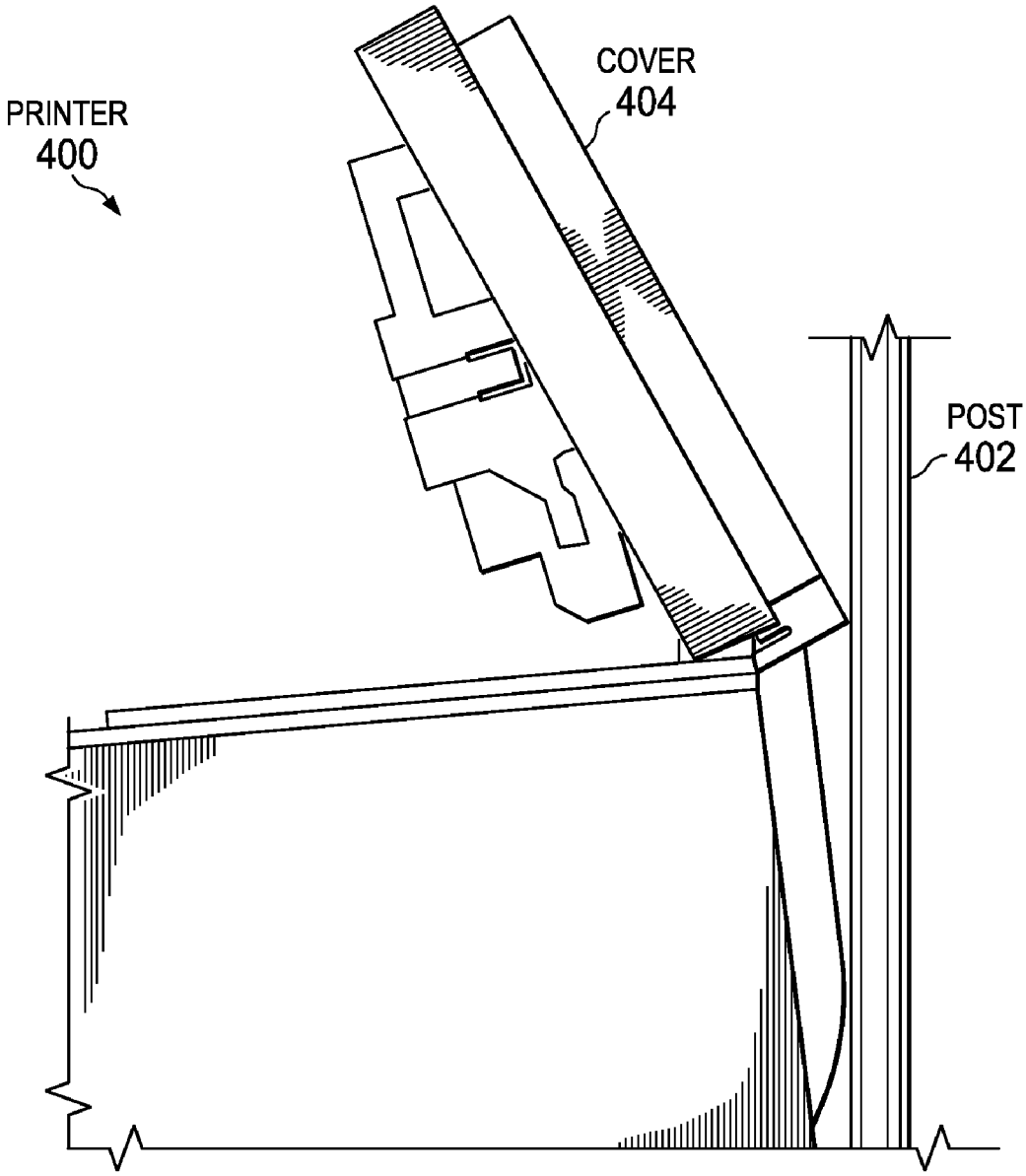
Figure 4D:
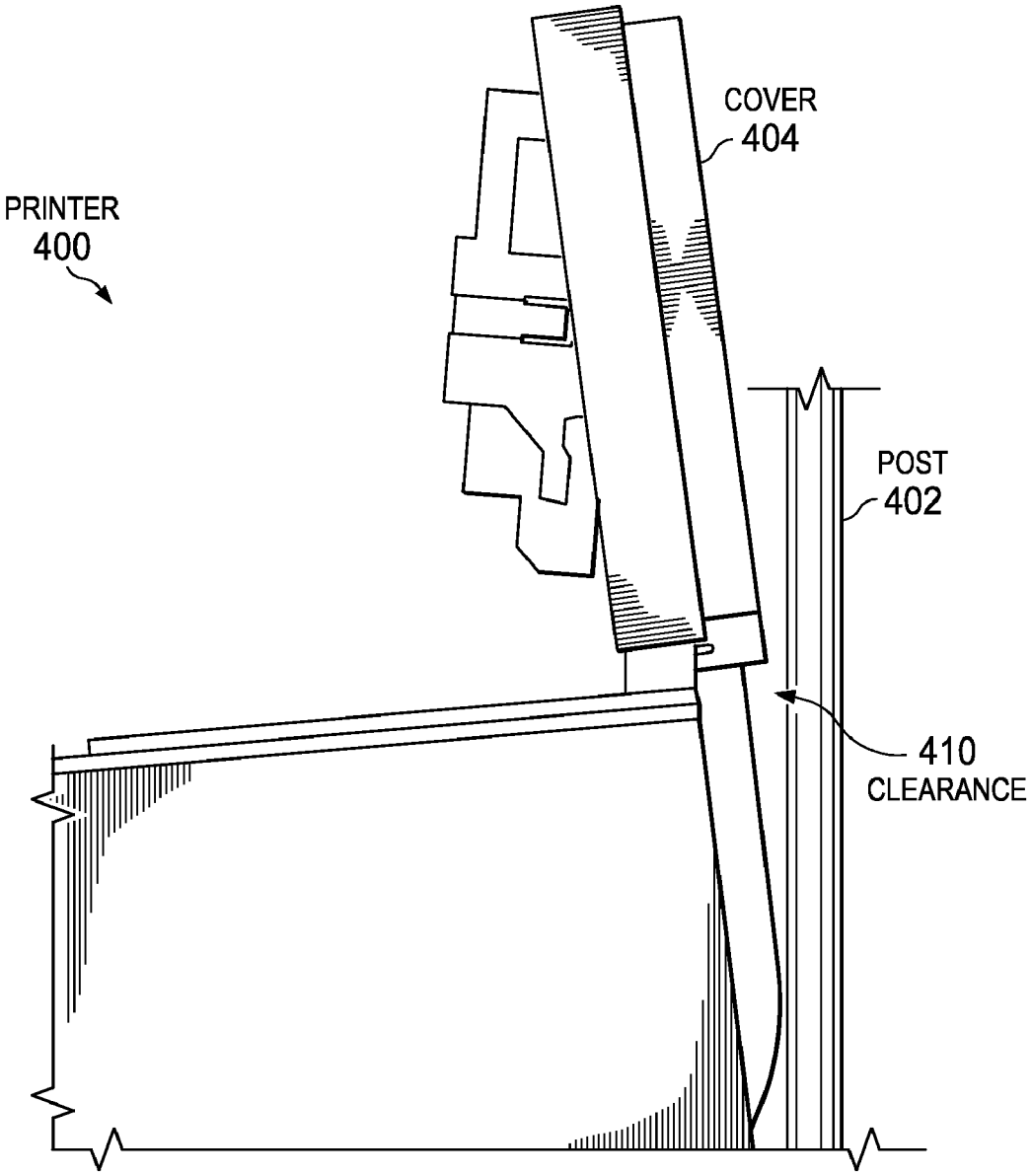

In FIG. 4C, printer 400 is shown with cover 404 continuing to rotate up. However, in accordance with an exemplary embodiment, cover 404 now rotates on a second pivot, which is not shown, creating clearance between cover 404 and post 402. FIG. 4D illustrates cover 404 in an opened position. Cover 404 moves inward and downward; therefore, avoids contacting post 402 and creating clearance 410, while allowing the printer to be fully opened and allowing paper to be loaded into printer 400. Further, as can been seen, when cover 404 is fully open, cover 404 does not extend beyond the footstep of printer 400.

Figure 5:
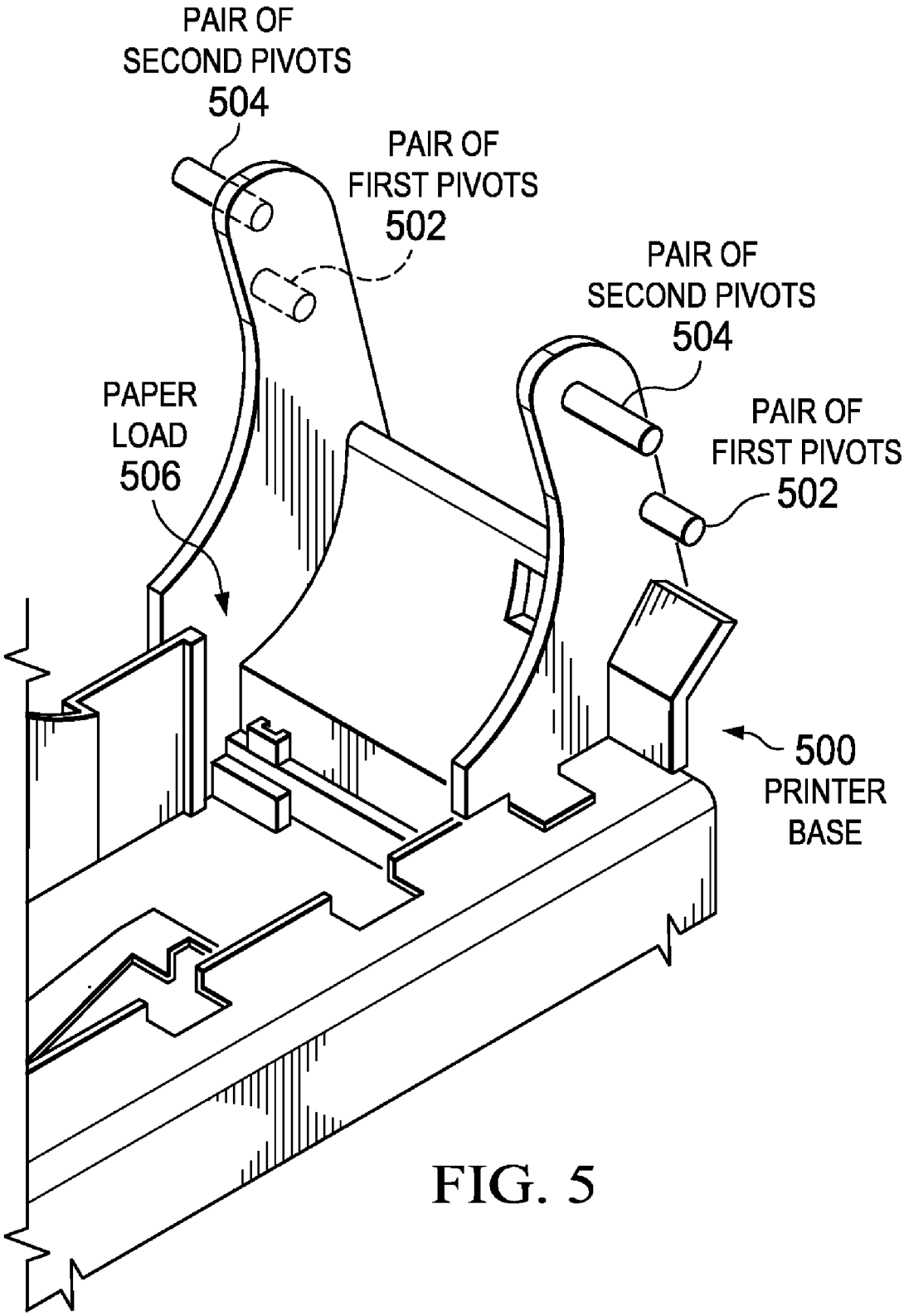
FIG. 5 illustrates a printer base in accordance with an exemplary embodiment.

FIG. 5 illustrates a printer base in accordance with an exemplary embodiment. Base 500 is a base of a printer onto which a printer cover may be coupled. Base 500 comprises an area for paper load 506, and two pairs of pivots, a pair of first pivots 502 and a pair of second pivots 504. According to an exemplary embodiment, a printer cover, which is not shown, pivots about the pair of first pivots 502 and the pair of second pivots 504.

Figure 6:
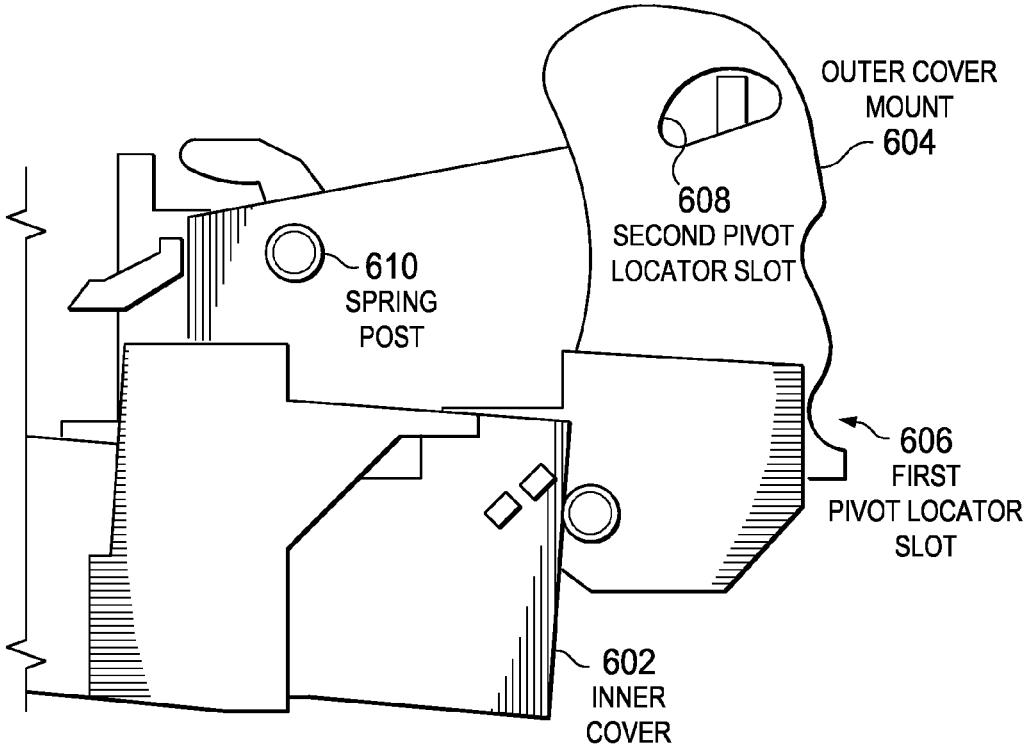
FIG. 6 illustrates an inner cover of a printer in accordance with an exemplary embodiment.

FIG. 6 illustrates an inner cover of a printer in accordance with an exemplary embodiment. Inner cover 602 has spring post 610 and is coupled to outer cover mount 604. Outer cover mount 604 is a pivot location unit. In an exemplary embodiment outer cover mount 604 comprises a solid piece of material with two pivot locator slots, first pivot locator slot 606 and second pivot locator slot 608. In the present example, the exact shape and composition of outer cover mount 604 is not intended to, in any way, limit exemplary embodiments to the example shown. Rather, exemplary embodiments contemplate that outer cover mount 604 may comprise any suitable material, such as metal or plastic and may be of any shape. Further, the pivot location unit, outer cover mount 604 may be comprised of more than one connected piece, so long as first pivot locator slot 606 and second pivot locator slot 608 are connected.

First pivot locator slot 606 is formed so as to be coupled to a first pivot, such as first pivot 502 in FIG. 5. Second pivot locator slot 608 is formed so as to be coupled to a second pivot, such as second pivot 504 in FIG. 5. The radius of second pivot locator slot 608 varies depending on the distance between a first pivot and a second pivot. According to an exemplary embodiment, the radius of second pivot locator slot 608 is the same as the distance between the center of the first pivot and second pivot, such as first pivot 502 and second pivot 504 in FIG. 5.

Figure 7:
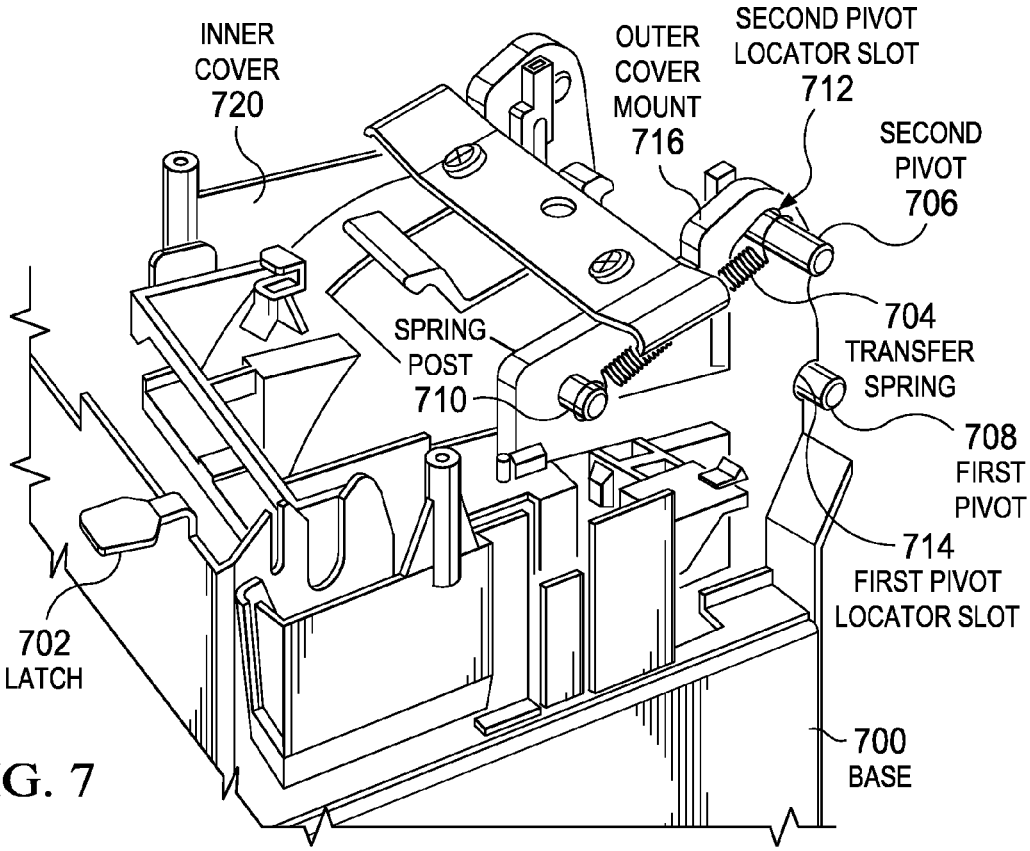
FIG. 7 illustrates an inner cover of a printer coupled to a printer base in accordance with an exemplary embodiment.

FIG. 7 illustrates an inner cover of a printer coupled to a printer base in accordance with an exemplary embodiment. Inner cover 720 is coupled to base 700 by second pivot 706. Base 700 may be implemented as a printer base, such as base 500 in FIG. 5. Inner cover 720 may be implemented as an inner cover, such as inner cover 602 in FIG. 6. Outer cover mount 716 is attached to inner cover 720. Second pivot 706 passes through second pivot locator slot 712 of outer cover mount 716.

One end of transfer spring 704 is coupled to spring post 710 of inner cover 720. The other end of transfer spring 704 is coupled to second pivot 706 on base 700 such that the end of transfer spring 704 is coupled to second pivot 706 between outer cover mount 716 and the end of second pivot 706. Latch 702 indicates that the inner cover 720 is latched to base 700 in a closed position. Latching inner cover 720 to base 700 through latch 702 will cause transfer spring 704 to be expanded. Additionally, latching inner cover 720 to base 700 through latch 702 pulls inner cover 720 and outer cover mount 716 against first pivot 708 at first pivot locator slot 714. Further, second pivot 706 is in a neutral position within second pivot locator slot 712, thus allowing for rotation about first pivot 708.

Figure 8:
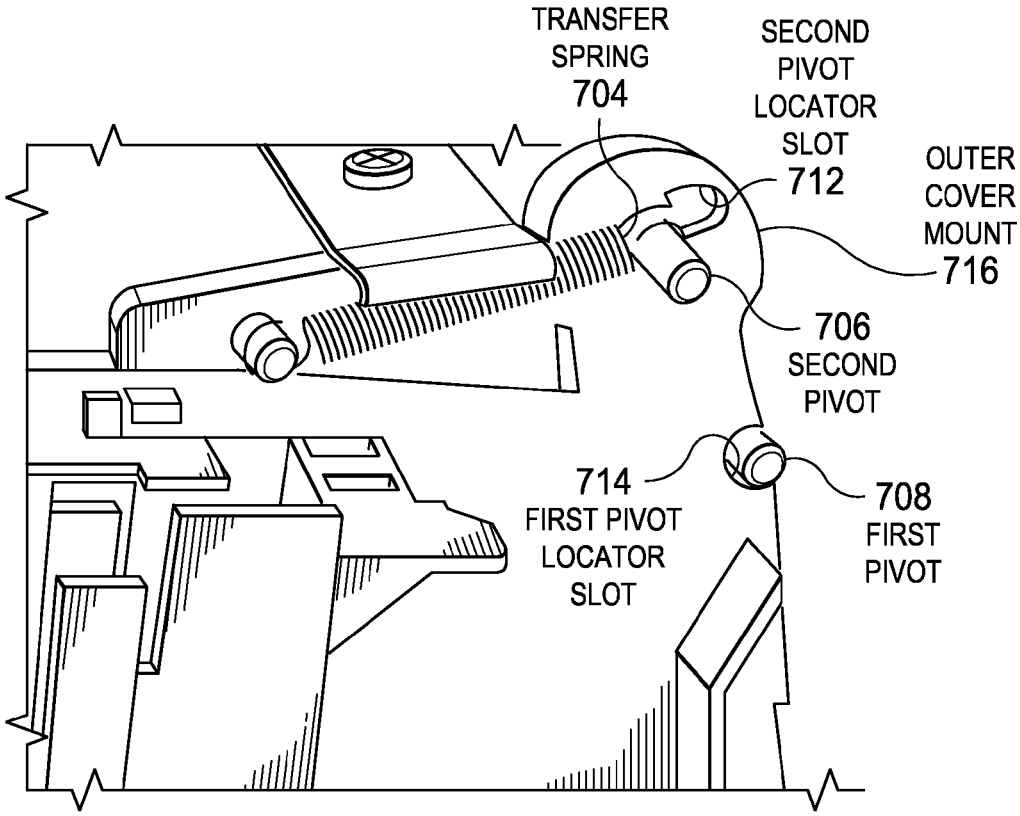
FIG. 8 illustrates an expanded view of a portion of FIG. 7 in accordance with an exemplary embodiment.

FIG. 8 illustrates an expanded view of a portion of FIG. 7 in accordance with an exemplary embodiment. When inner cover 720 of FIG. 7 is unlatched from base 700 in FIG. 7, transfer spring 704 contracts, as shown in FIG. 8, causing inner cover 720 and outer cover mount 716 to rotate, or pivot, about first pivot 708. As transfer spring 704 contracts, first pivot locator slot 714 and outer cover mount 716 move away from and loose contact with first pivot 708.

Further, as transfer spring 704 continues to contract, second pivot locator slot 712 and outer cover mount 716 move such that second pivot locator slot 712 moves to a second position, engaging second pivot 706. This transfers the rotation of inner cover 720 and outer cover mount 716 to pivot about second pivot 706 via a cover opening spring that expands, which is not shown.

Figure 9:
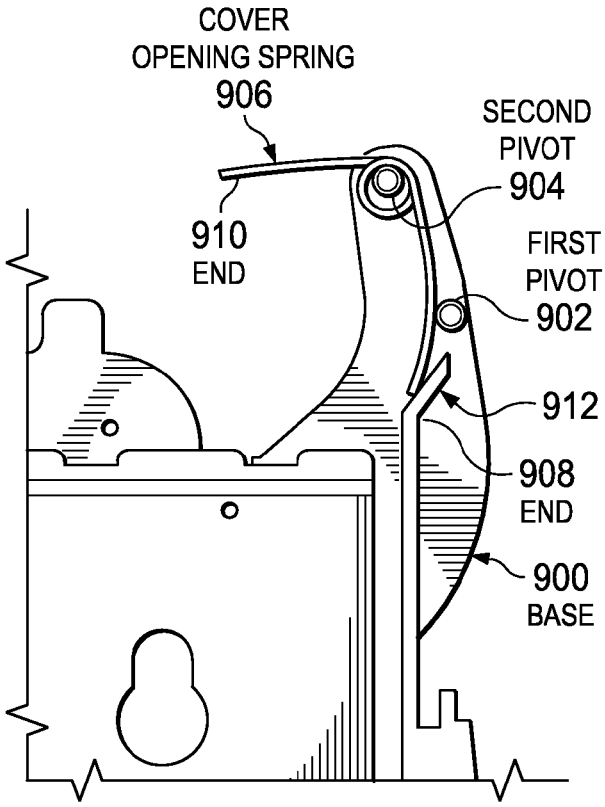
FIG. 9 illustrates a cover spring in accordance with an exemplary embodiment.

FIG. 9 illustrates a cover spring in accordance with an exemplary embodiment. Base 900 is a printer base, which may be implemented as a base such as base 700 in FIG. 7. Base 900 comprises a first pivot 902 and a second pivot 904. Cover opening spring 906 fits over second pivot 904. One end 908 of cover opening spring 906 is coupled to base 900 at 912. The other end 910 of cover opening spring 906 is coupled to a printer cover, not shown, such as cover 404 of FIG. 4.

Figure 10A:
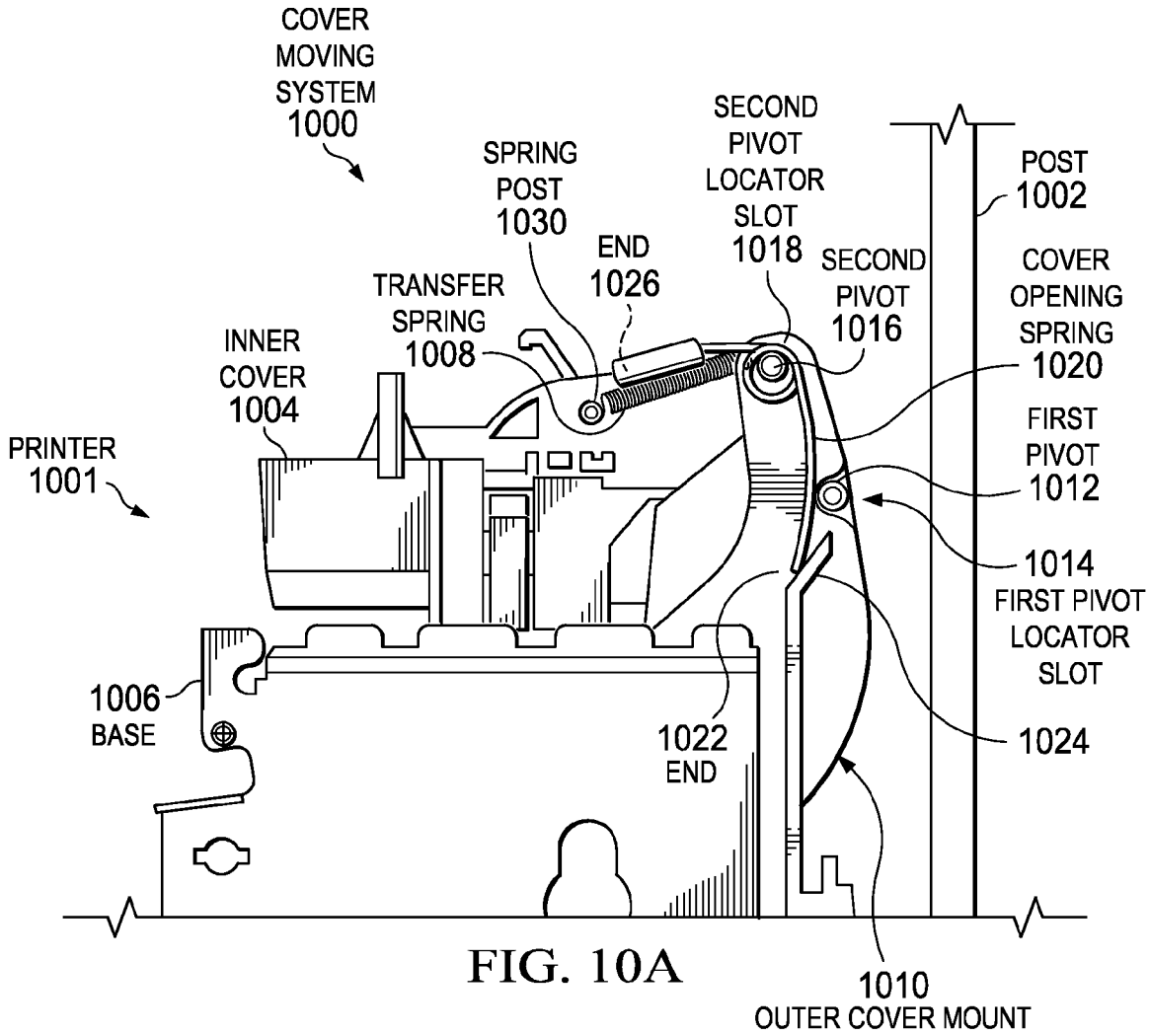
FIGS. 10A-10D illustrate an example of opening a printer cover with the outer cover removed in accordance with an exemplary embodiment.

FIGS. 10A-10D illustrate an example of a printer cover moving system in accordance with an exemplary embodiment. FIGS. 10A-10D are a side view of a portion of printer 1001. Printer 1001 is a non-limiting example of printer 115 in FIG. 1 and printer 200 in FIG. 2. As shown in FIGS. 10A-10D, printer 1001 is close to post 1002. In FIGS. 10A-10D, cover moving system 1000, comprises base 1006, inner cover 1004, outer cover mount 1010, transfer spring 1008, and cover opening spring 1020. In FIG. 10A, printer 1001 is shown in a closed position; with inner cover 1004 latched close to base 1006.

Base 1006 comprises first pivot 1012, second pivot 1016, and spring post 1030. Inner cover 1004 is coupled to base 1006 by second pivot 1016. Outer cover mount 1010 is attached to inner cover 1004. Second pivot 1016 passes through second pivot locator slot 1018 of outer cover mount 1010. Transfer spring 1008 is coupled to spring post 1030 and second pivot 1016.

Inner cover 1004 and outer cover mount 1010 rest against first pivot 1012 at first pivot locator slot 1014. Further, second pivot 1016 is in a neutral position within second pivot locator slot 1018, thus allowing for rotation about first pivot 1012. Transfer spring 1008 is in an expanded state.

Cover opening spring 1020 fits over second pivot 1016. One end 1022 of cover opening spring 1020 is coupled to base 1006 at 1024. The other end 1026 of cover opening spring 1020 is coupled to a printer cover, not shown, such as cover 404 of FIG. 4.

Figure 10B:
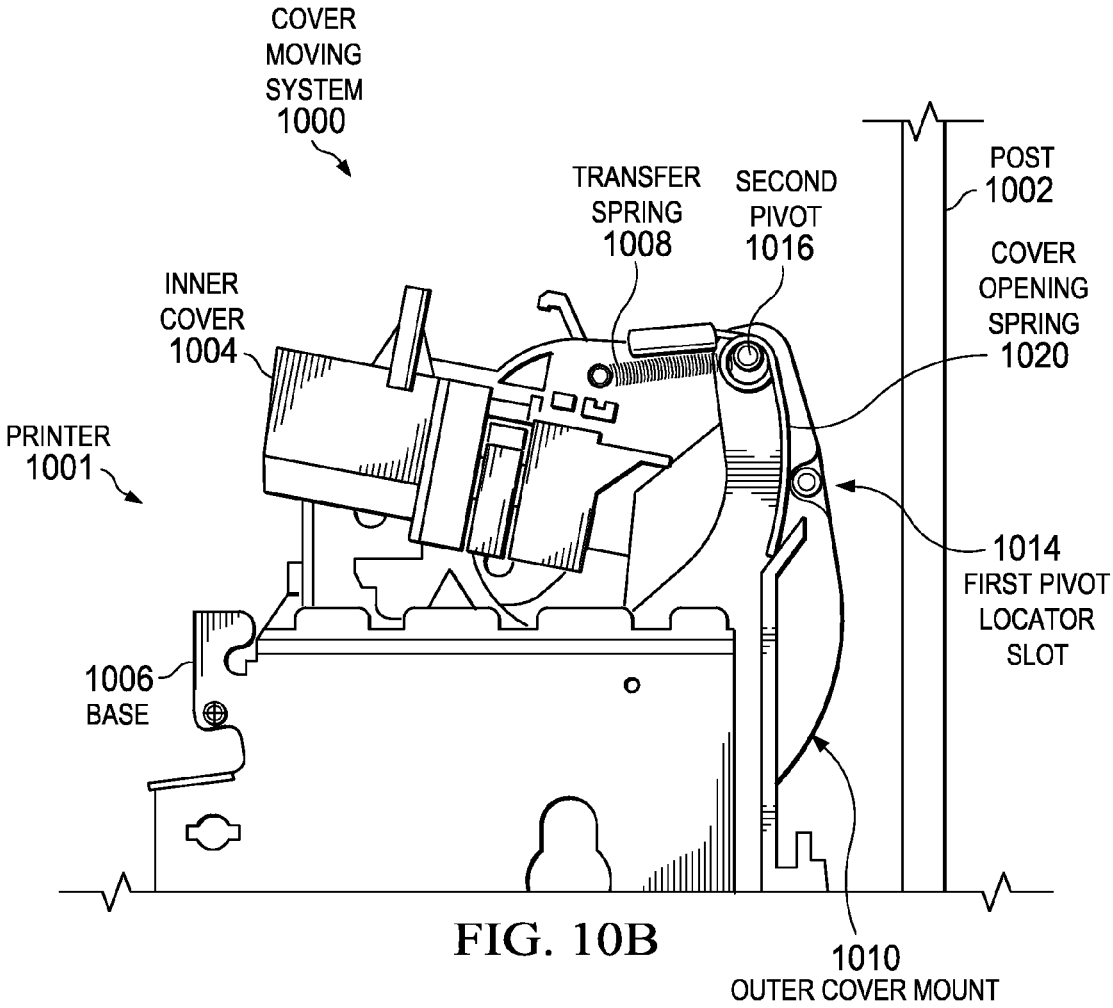

FIG. 10B shows printer 1001 as inner cover 1004 begins to rotate up and pivot around first pivot 1012. At this point, transfer spring 1008 begins to contract, lifting inner cover 1004.

Figure 10C:
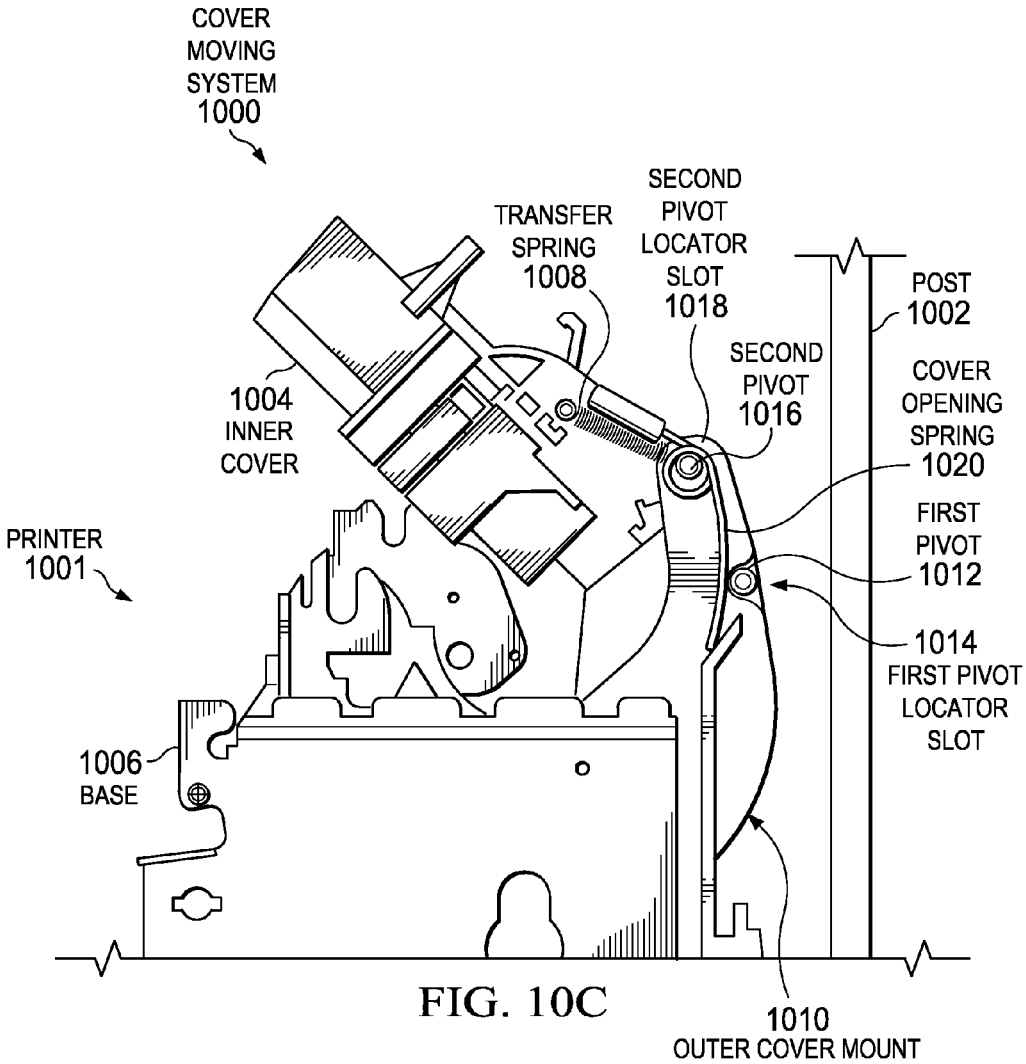

In FIG. 10C inner cover 1004 is shown continuing to rotate up into an open potion. As transfer spring 1008 contracts, inner cover 1004 and outer cover mount 1010 rotate, or pivot, about first pivot 1012. As inner cover 1004 and outer cover mount 1010 pivot about first pivot 1012, first pivot locator slot 1014 moves away from and loses contact with first pivot 1012.

Further, the contraction of transfer spring 1008 causes second pivot locator slot 1018 and outer cover mount 1010 to move to a position such that second pivot locator slot 1018 moves to a second position, engaging second pivot 1016. This transfers the rotation of inner cover 1004 and outer cover mount 1010 to pivot about second pivot 1016 via cover opening spring 1020.

Figure 10D:
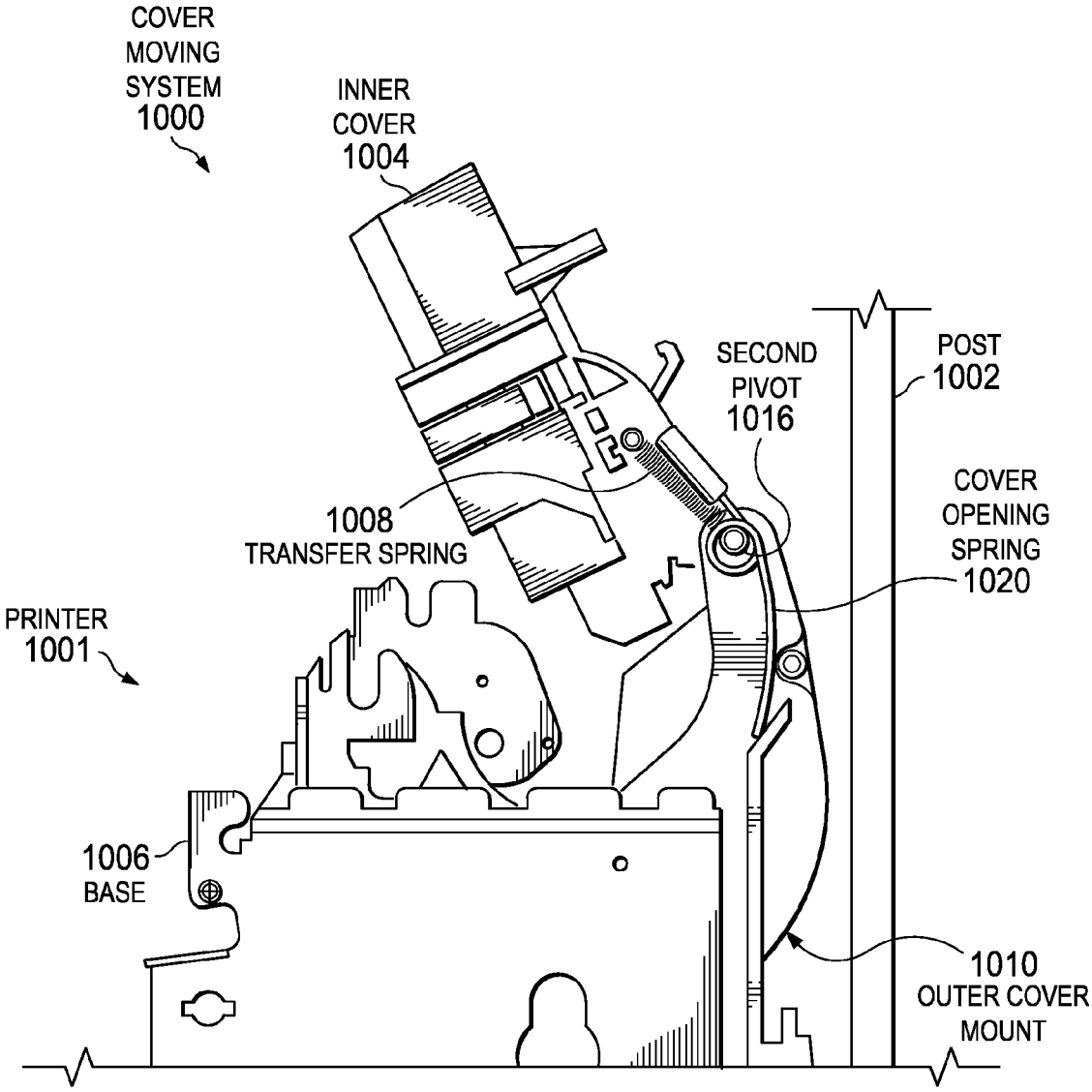

FIG. 10D illustrates inner cover 1004 in an opened position. Cover opening spring 1020 has expanded, causing inner cover 1004 to pivot about second pivot 1016. The resulting motion causes a cover, such as cover 404 in FIG. 4 to move inward and downward; therefore, avoids contacting post 1002 and creating a clearance between the printer cover and post, such as clearance 410 in FIG. 4D.

Printer inner cover 1004 is in a fully open position, which allows paper to be loaded into printer 1001.

Figure 11A:
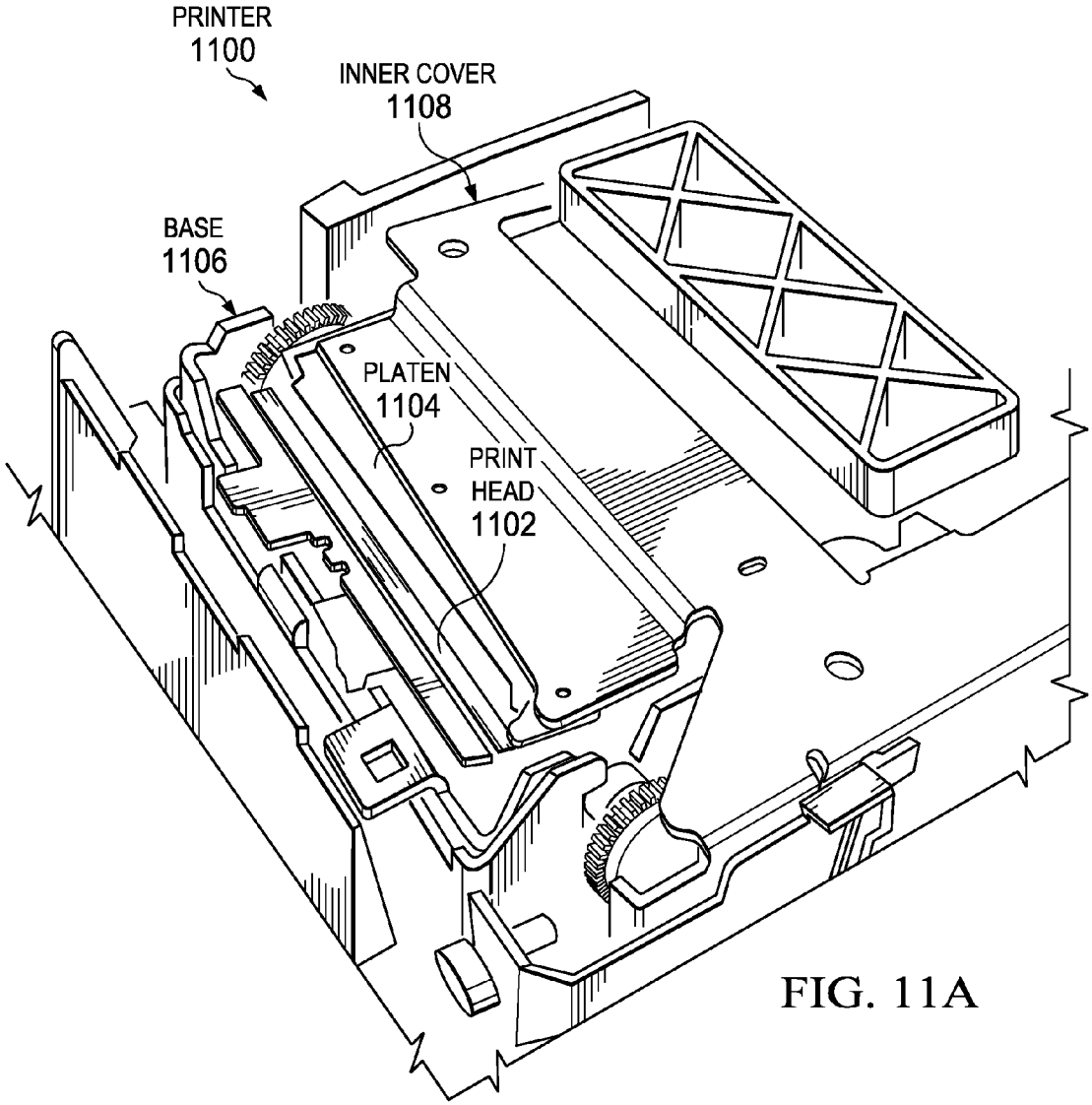
FIGS. 11A and 11B illustrate moving a cover to clear a platen and print head in accordance with an illustrative embodiment.
Figure 11B:
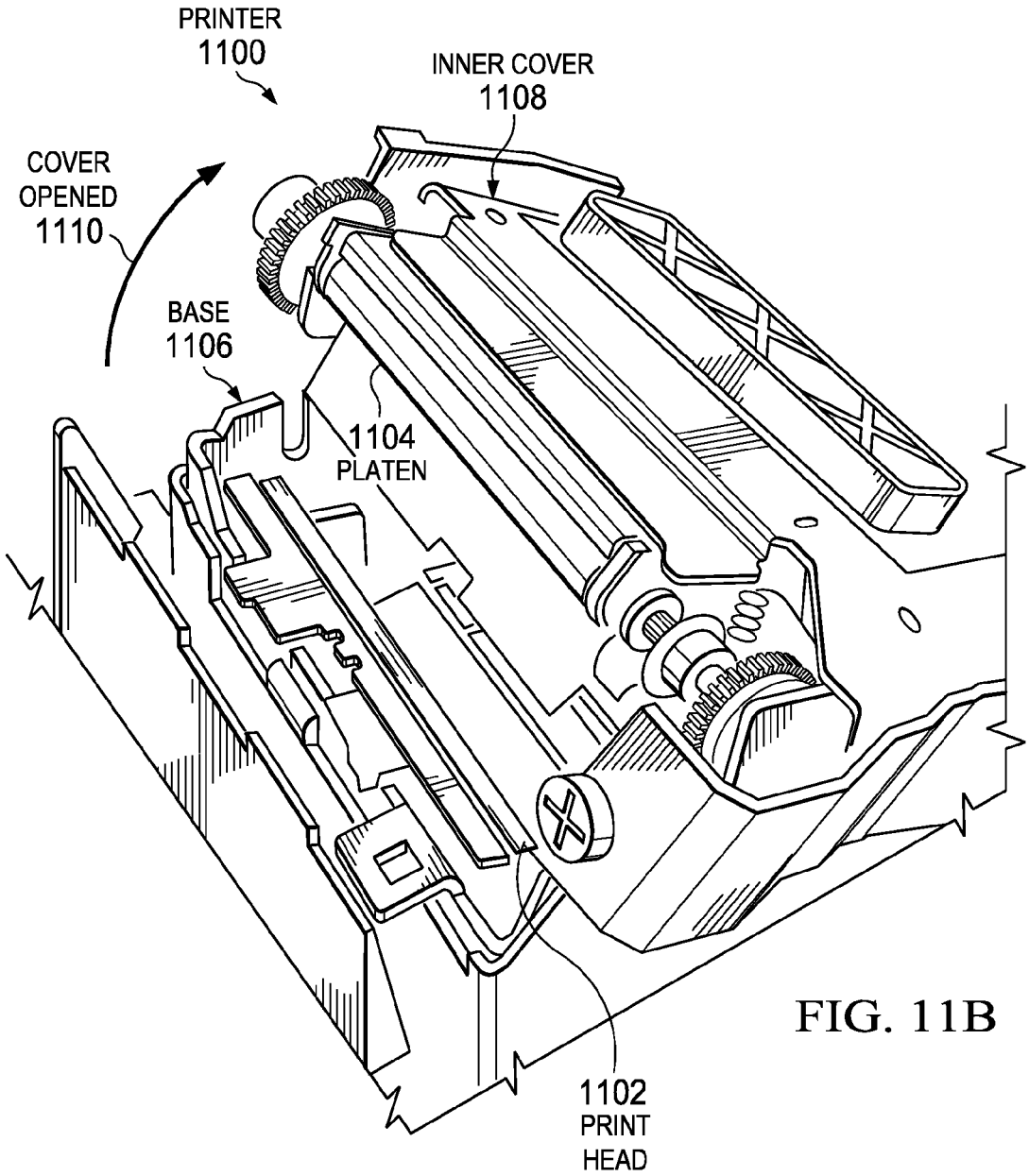

FIGS. 11A and 11B illustrate moving a cover to clear a platen and print head in accordance with an illustrative embodiment. FIGS. 11A and 11B are oblique views of a portion of a printer 1100. Printer 1100 is a non-limiting example of printer 115 in FIG. 1 and printer 200 in FIG. 2. Printer 1100 comprises platen 1104, which is coupled to inner cover 1108 and print head 1102, which is coupled to base 1106. Platen 1104 feeds paper against print head 1102. Therefore, platen 1104 must be prevented from coming into contact with print head 1102, as platen 1104 could damage print head 1102 if platen 1104 encountered print head 1102.

The cover (not shown) is opened 1110 using a cover moving system, such as cover moving system 1000 in FIG. 10, not shown. Movement about the pivots of the cover moving system allows platen 1104 to move away from print head 1102 without contacting print head 1102, while the cover remains within the footprint of the printer.

Figure 12:
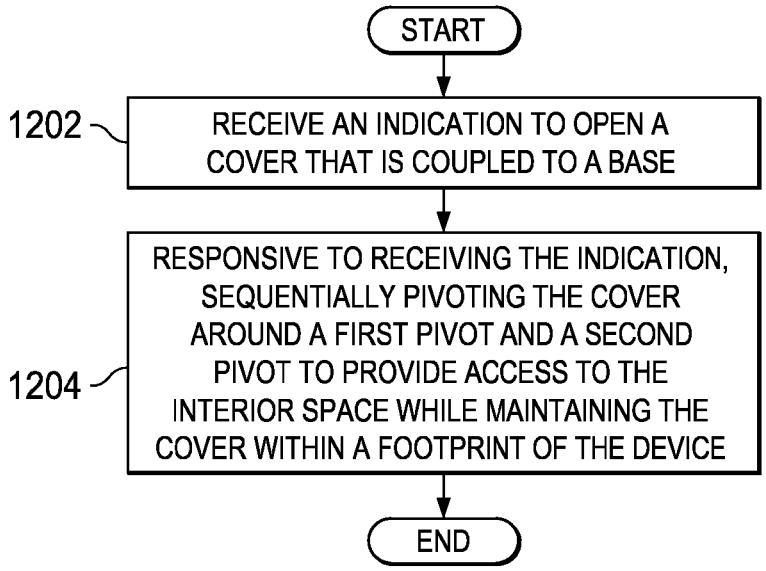
FIG. 12 is a flowchart illustrating the operation of moving a cover in accordance with an illustrative embodiment.

FIG. 12 is a flowchart illustrating the operation of moving a cover in accordance with an illustrative embodiment. The process illustrated in FIG. 12 may be implemented by a cover moving system, such as cover moving system 1000 in FIG. 10. The process begins by receiving an indication to open a cover that is coupled to a base (step 1202). For example, the indication may be from a user or an external device. Responsive to receiving the indication, sequentially pivoting the cover around a first pivot and a second pivot to provide access to the interior space while maintaining the cover within a footprint of the device (step 1204) and the process ends. The cover is sequentially pivoted around the first pivot and the second pivot by sequentially contracting a first flexible band for pivoting the cover around the first pivot and expanding a second flexible band for pivoting the cover around the second pivot.

Figure 13:
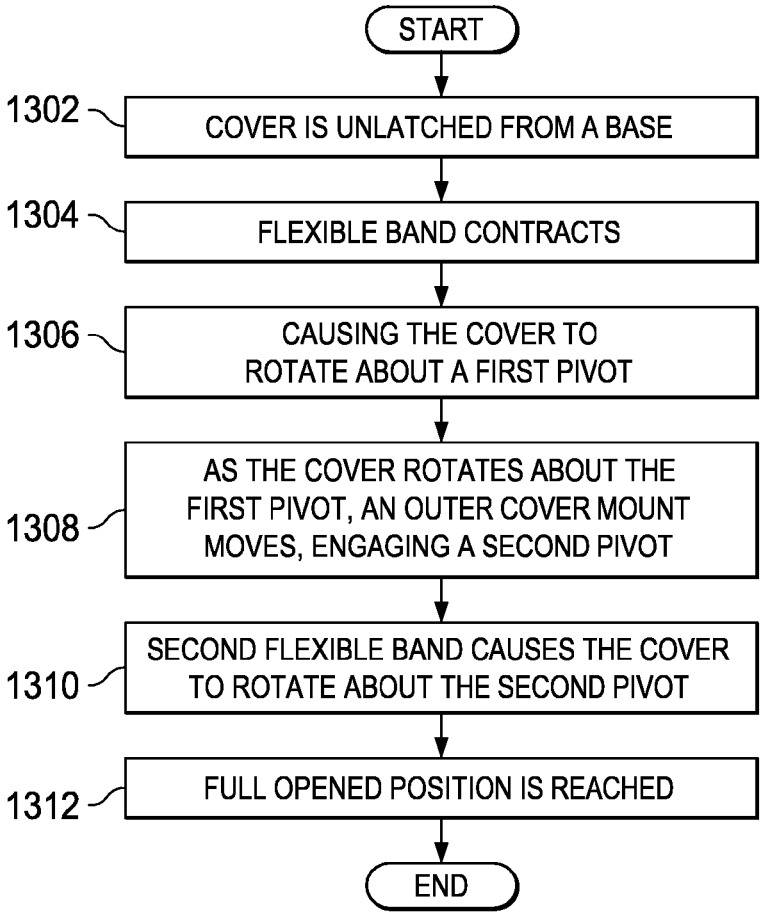
FIG. 13 is a flowchart illustrating the operation of pivoting a printer cover about two pivots in accordance with an illustrative embodiment.

FIG. 13 is a flowchart illustrating the operation of pivoting a printer cover about two pivots in accordance with an illustrative embodiment. The process illustrated in FIG. 13 may be implemented by a cover moving system, such as cover moving system 1000 in FIG. 10. The operation begins when a cover is unlatched from a base (step 1302). The cover is connected to an outer cover mount that is connected to an inner cover. The inner cover is latched to the base. A flexible band contracts (step 1304), causing the cover to rotate about a first pivot (step 1306). The flexible band is connected to the inner cover and a second pivot. As the cover rotates about the first pivot, an outer cover mount moves, engaging a second pivot (step 1308) and disengaging the first pivot. A second flexible band expands, causing the cover to rotate about the second pivot (step 1310) until a full opened position is reached (step 1312) and the operation ends.

It should be noted that while exemplary embodiments have been described in terms of a printer and printer cover, exemplary embodiments encompass any type of covered device, such as a fax machine, scanner, and so forth.

Thus, illustrative embodiments described herein provide a method and apparatus for moving a printer cover to clear a platen and print head while remaining within the footprint of the printer. The apparatus includes a base. A base is any device onto which a cover may be attached. The apparatus also includes a cover pivotably coupled to the base. As used herein, the term "coupled" includes coupling via a separate object. For example, the cover may be coupled to the base if both the cover and the base are coupled to a third object. The term "coupled" also includes "directly coupled," in which case the two objects touch each other in some way. The term "coupled" also encompasses two or more components that are continuous with one another by virtue of each of the components being formed from the same piece of material.

The apparatus in the illustrative embodiments also includes a set of flexible bands. The set of flexible bands includes two or more flexible bands. In one illustrative embodiment, the set of flexible bands are a set of extension springs. In an alternate illustrative embodiment, the set of flexible bands are a set of torsion springs. In one illustrative embodiment, the set of flexible bands are a set of tension bands.

A first end of a first member of the set of flexible bands is coupled to the cover. A second end of the first member of the set of flexible bands is coupled to the base. Both ends of a second member of the set of flexible bands are coupled to the base at a set of second points. The set of flexible bands are adapted to bias the cover into an open position.

In one illustrative embodiment, the base is a printer, such as a point of sale printer. In this embodiment, the cover may be a printer cover. In one example, the set of flexible bands urge or bias the printer cover into the open position when the printer cover is opened by a user. In another example, the printer cover may be opened by the user using a button on the point of sale printer.

In an illustrative embodiment, after a cover is released from a base, the cover begins to rotate upwards and pivot around a first pivot. A first flexible band begins to contract, lifting the cover. As the cover pivots about the first pivot, the first flexible band completes contracting. At this point, a second flexible band is engaged. The second flexible band causes the cover to pivot about a second pivot until the cover attains a fully opened position. The cover pivots about the second pivot through an inward and downward motion. This causes the cover to remain with a footprint of the printer throughout the entire process of opening the cover.

The flowcharts and block diagrams in the different depicted embodiments illustrate the architecture, functionality, and operation of some possible implementations of apparatus and methods. In this regard, each block in the flowchart or block diagrams may represent a module, segment, or portion of code, which comprises one or more executable instructions for implementing the specified function or functions. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An apparatus for moving a cover of a device relative to a base of the device to provide access to an interior space, the apparatus comprising:

a first pivot;

a second pivot;

a pivoting mechanism, responsive to a user opening the cover, for sequentially pivoting the cover around the first pivot and the second pivot to provide access to the interior space while maintaining the cover within a footprint of the device, the pivoting mechanism including a first resilient member for pivoting the cover around the first pivot, wherein the first resilient member pivots the cover around the first pivot by contracting, and a second resilient member for pivoting the cover around the second pivot, wherein the second resilient member pivots the cover around the second pivot by expanding; and wherein the cover is coupled to the base.

2. The apparatus of claim 1, wherein a first end of the first resilient member is coupled to the base and a second end of the first resilient member is coupled to an inner cover, which is coupled to the cover; and wherein the first end of the second resilient member is coupled to the base and the second end of the second resilient member is coupled to the cover.

3. The apparatus of claim 1, wherein the first pivot and the second pivot are coupled to the base.

4. The apparatus of claim 1, wherein the first pivot is coupled to a first pivot locator slot and wherein the second pivot is coupled to a second pivot locator slot.

5. The apparatus of claim 4, wherein a radius of the second pivot locator slot equals a distance between the center of the first pivot and a center of the second pivot.

6. An apparatus for moving a cover of a printer relative to a base of the printer while remaining within a footprint of the printer, the apparatus comprising:

a first pivot;

a second pivot;

a pivoting mechanism, for sequentially pivoting the cover around the first pivot and the second pivot, the pivoting mechanism including a first resilient member for pivoting the cover around the first pivot, responsive to a user opening the cover, wherein the first resilient member pivots the cover around the first pivot by contracting, and a second resilient member for pivoting the cover around the second pivot, responsive to the cover moving around the first pivot and engaging the second pivot, wherein the second resilient member pivots the cover around the second pivot by expanding;

wherein the pivoting mechanism maintains the cover within the footprint of the printer responsive to the cover moving sequentially around the first pivot and the second pivot; and wherein the cover is coupled to the base.

7. The apparatus of claim 6, wherein the cover is a first cover and the apparatus further comprising:

a second cover coupled to the first cover, wherein the second cover is inside of the first cover;

wherein a first end of the first resilient member is coupled to the base and a second end of the first resilient member is coupled to the first cover; and wherein the first end of the second resilient member is coupled to the base and the second end of the second resilient member is coupled to the cover.

8. The apparatus of claim 6, wherein the first pivot and the second pivot are coupled to the base.

9. The apparatus of claim 6, wherein the first pivot is coupled to a first pivot locator slot and wherein the second pivot is coupled to a second pivot locator slot.

10. The apparatus of claim 9, wherein a radius of the second pivot locator slot equals a distance between a center of the first pivot and the center of the second pivot.

11. The apparatus of claim 10, wherein the first pivot locator slot and the second pivot locator slot are part of a single device.

12. The apparatus of claim 9, wherein the cover moving around the first pivot causes the first pivot locator slot to uncouple from the first pivot and causes the second pivot locator slot to engage the second pivot.

* * * * *